United States Patent [19]

Hsieh et al.

[11] Patent Number: 4,882,895

[45] Date of Patent: Nov. 28, 1989

[54] AUTOMATED APPARATUS FOR TRANSPORTING, LINING-UP AND STOWING CYLINDRICAL FRAGILE BODIES

[75] Inventors: Min-Lang Hsieh; Jan-Hong Huang; Lian Jan; Gang-Shyr Guan, all of Hsinchu Hsien, Taiwan

[73] Assignee: Industrial Technology Research Institute, Hsinchu Hsien, Taiwan

[21] Appl. No.: 198,121

[22] Filed: May 24, 1988

[51] Int. Cl.[4] ..... B65B 35/30

[52] U.S. Cl. ..... 53/531; 53/55; 53/247; 53/252; 53/500; 53/534

[58] Field of Search ..... 53/55, 64, 148, 236, 53/247, 252, 500, 530, 531, 534, 537

[56] References Cited

U.S. PATENT DOCUMENTS 4,134,330 1/1979 Weickenmeier ..... 53/500

*Primary Examiner*—W. Donald Bray

*Attorney, Agent, or Firm*—Ladas & Parry

[57] ABSTRACT

An automated apparatus for transporting, lining-up and stowing cylindrical fragile bodies. It promotes efficiency of the stowing operation and ensures sanitation during stowing. Furthermore it disposes cylindrical fragile bodies within receptacles in a compact manner. The apparatus according to this invention comprises a receptacle supply mechanism for supplying receptacles; a transportation and mechanism for lining-up cylindrical fragile bodies and transporting them; a push mechanism for accommodating cylindrical fragile bodies coming from the lining-up mechanism temporarily, and pushing them out in lots and in a predetermined sequence; a stowage mechanism for receiving cylindrical fragile bodies coming from the push mechanism and stowing them into receptacles coming from the receptacle supply mechanism; an elevation-position mechanism for elevating the receptacles coming from the receptacle supply mechanism and holding them temporarily at a location near the receiving means; a vibrating mechanism for vibrating the receptacles so as to make the cylindrical fragile bodies stow into the receptacles to be arranged in a compact manner; and a microprocessor for controlling the processes of transporting, lining-up and stowing cylindrical fragile bodies.

10 Claims, 6 Drawing Sheets

4

AUTOMATED APPARATUS FOR TRANSPORTING, LINING-UP AND STOWING CYLINDRICAL FRAGILE BODIES

BACKGROUND OF THE INVENTION

The present invention relates to an automated apparatus for transporting, lining-up and stowing fragile bodies, and particularly to one which can automatically handle cylindrical fragile bodies.

At the present time, the entire wrapping process of fragile biscuits, such as egg rolls, including stowing, packing, boxing, etc. cannot be effectively and efficiently automated, especially when stowing is concerned because they are too fragile to transport and line-up, and to stow into receptacles without breakage. For the above reasons, large amounts of manual labor is expended on stowing, resulting in inefficency and high cost. Besides, santitation is a major consideration when manual labor is ultilized in the prodution process.

SUMMARY OF THE INVENTION

It is therefore an object of this invention to provide an automated apparatus for transporting, lining-up and stowing cylindrical fragile bodies to upgrade the efficiency of the stowing operation and to enforce sanitation.

It is another object of this invention to provide an automated apparatus for transporting, lining-up and stowing cylindrical fragile bodies to dispose cylindrical fragile bodies within receptacles in a compact manner.

The above objects can be achieved by an automated apparatus for transporting, lining-up and stowing cylindrical fragile bodies, which comprises a receptacle supply mechanism for supplying receptacles; a transportation mechanism for lining-up cylindrical fragile bodies and transporting them a push mechanism for accommodating cylindrical fragile bodies coming from the transportation mechanism temporarily, and sending them out in lots and in a predetermined sequence; a stowage mechanism for receiving cylindrical fragile bodies coming from said push mechanism and stowing them into receptacles coming from the supplying mechanism; an elevation-position mechanism for elevating the receptacles coming from receptacle supply mechanism and holding them temporarily at a location near the stowage mechanism; a vibration mechanism for vibrating the receptacles so as to make the cylindrical fragile bodies stowed into the receptacles to be arranged in a compact manner; and a microprocessor for controlling the processes of transporting, lining-up and stowing cylindrical fragile bodies.

Other and further objects, features and advantages of this invention will appear more fully in the following description.

BRIEF DESCRIPTION OF THE DRAWINGS

This invention will be explained in more detail on the basis of an exemplary embodiment with reference to the drawings, in which.

DETAILED DESCRIPTION OF THE PREFERRED EMBODIMENT

Figure 1:
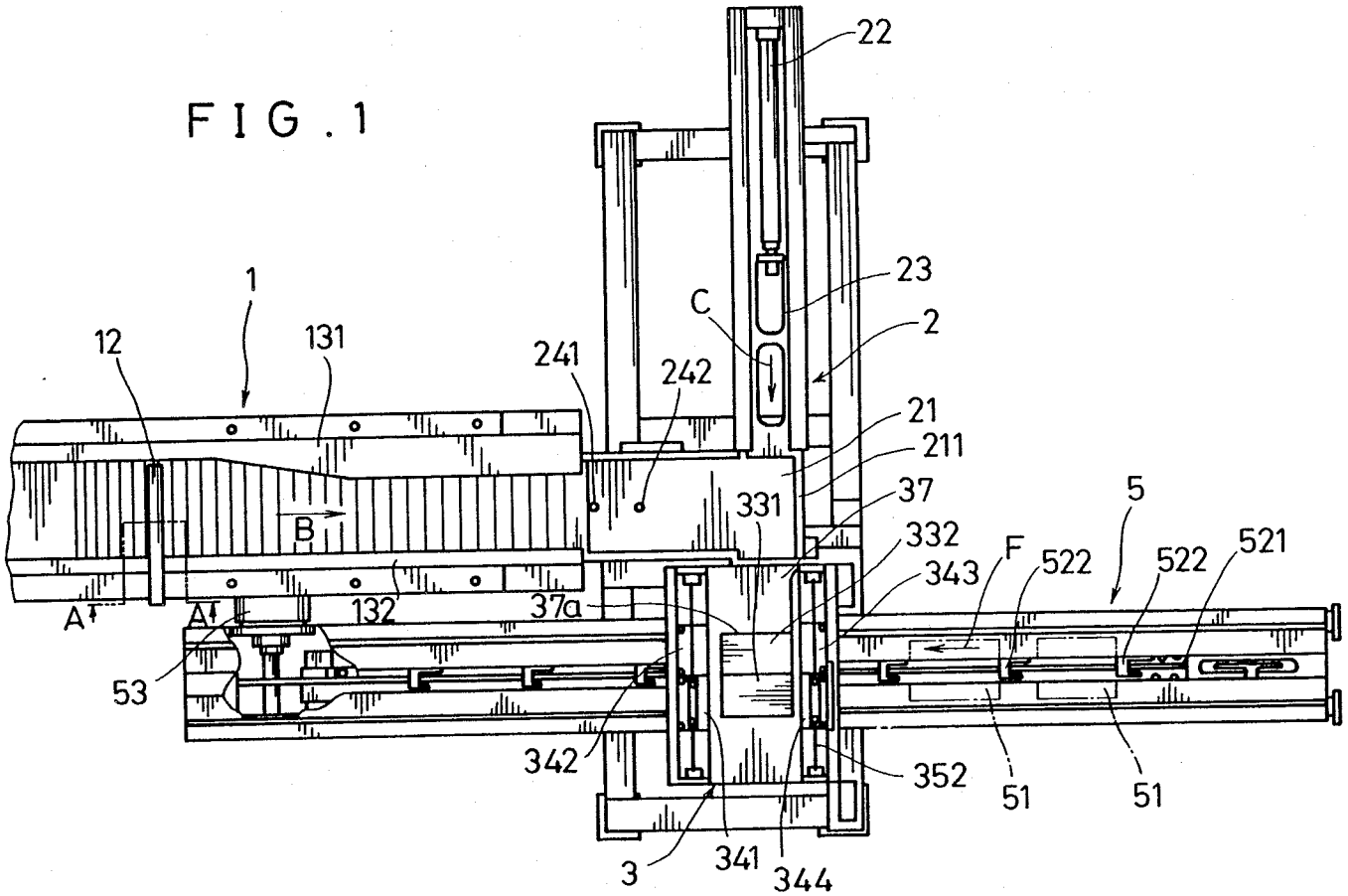
FIG. 1 is a top view of a preferred embodiment of the automated apparatus for transporting, lining-up and stowing cylindrical fragile bodies according to this invention.
Figure 3:
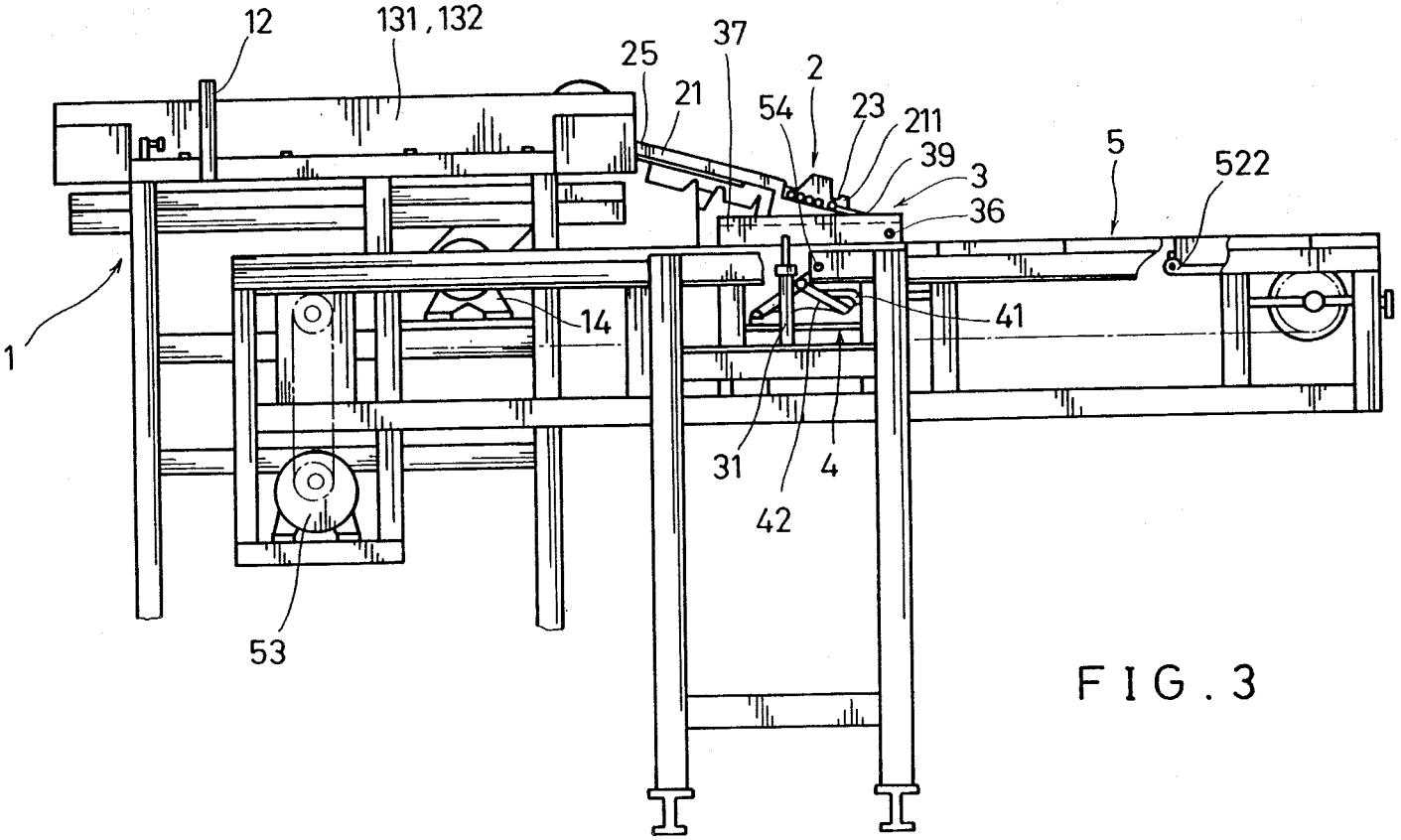
FIG. 3 is an elevational side view showing a preferred embodiment of the automated apparatus for transporting, lining-up and stowing cylindrical fragile bodies according to this invention.

As shown in FIG. 1 and FIG. 3, the automated apparatus for transporting, lining-up and stowing cylindrical fragile bodies according to this invention comprises a transportation 1, a push mechanism 2, a stowage mechanism 3, an elevation-position mechanism 4, a receptacle supply mechanism 5, and a vibration mechanism 6.

Figure 2:
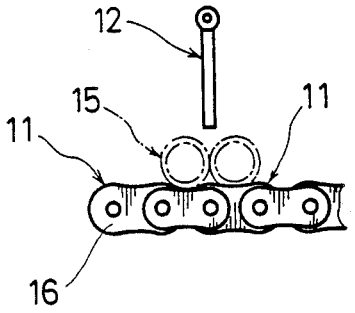
FIG. 2 is a sectional view along the arrows A—A shown in FIG. 1.

As shown in FIGS. 1–3, the transportation mechanism 1 comprises one pair of parallel chains 16, 16 (see FIG. 24); a plurality of cylindrical tubes 11, 11, . . . (see FIG. 24) juxtaposed with each other between two chains 16, 16 and being perpendicular to two chains 16, 16; a motor 14 (see FIG. 3) for driving two chains 16, 16; an upper guide plate 12 (see FIG. 24) spaced apart from the tubes 11, 11, . . . at a preset distance; and one pair of side guide plates 131, 132 (see FIG. 1) disposed on opposite sides of and in the longitudinal direction of chains 16, 16. Ordinarily, cylindrical fragile bodies 15, 15, . . . , such as egg rolls, are supplied onto the tubes 11, 11, . . . from a supply source (not shown). Each of the fragile bodies 15, 15, . . . will be interposed between two tubes 11, 11, . . . , and the upper guide plate 12 ensures that the fragile bodies 15, 15, . . . will not pile up together, that is, the upper guide plate 12 will push down any piled bodies and align them in a juxtaposed manner, when the chains 16, 16 are driven to move in the direction of arrow B. The narrow gap between two the side guide plates 131, 132 is so precisely determined that it equals the longitudinal length of each of the fragile bodies. By this arrangement, both ends of each fragile body will be lined up by the side guide plates 131, 132, when the chains 16, 16 are driven to move continuously.

As shown in FIGS. 1 and 3, the push mechanism 2 comprises an inclined storage chute 21, preferably at an inclined angle of about 17 degrees; one pair of photoelectric sensors 241, 242 mounted on the chute 21; an air cylinder 22; and a slide plate 23 driven to move reciprocally by the air cylinder 22. The storage chute 21 is shaped like a rectangular duct having a bottom ridge 211 formed on the lower end portion thereof. The fragile bodies 15, 15, . . . coming from the transportation mechanism 1 will slide down through the passage formed within the chute 21 and be impeded by the bottom ridge 211 to align on the chute 21 in a juxtaposed manner. When the row of fragile bodies 15, 15, . . . aligned on the chute 21 reaches the photoelectric sensor 242, the air cylinder 22 is activated to drive the slide plate 23 to move in the direction of the arrow "C" across the lower portion of the chute 21, which has no side walls because they will hinder the motion of the slide plate 23, to push the fragile bodies 15, 15, . . . aligned in front of the slide plate 23, onto the receiving plate 37 (as will be described below) of the stowage mechanism 3. It should be noted that the width of the slide plate 23 covers several (or predetermined number of) fragile bodies 15, 15, . . . , and said several fragile bodies will be pushed simultaneously at one time. The rotation of the motor 14 will pause when the row of fragile bodies 15, 15, . . . reaches the photoelectric sensor 241 after passing through the photoelectric sensor 242. At the same time, the operation of the transportation mechanism 1 will be stopped to avoid any overflow of fragile bodies 15, 15, . . .

Figure 6:
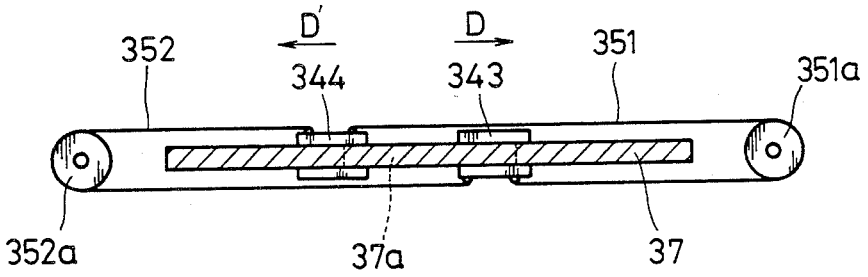
FIG. 6 is a simplified elevational view showing how the slides of the stowage mechanism shown in FIG. 5 can be driven to move.
Figure 2A:
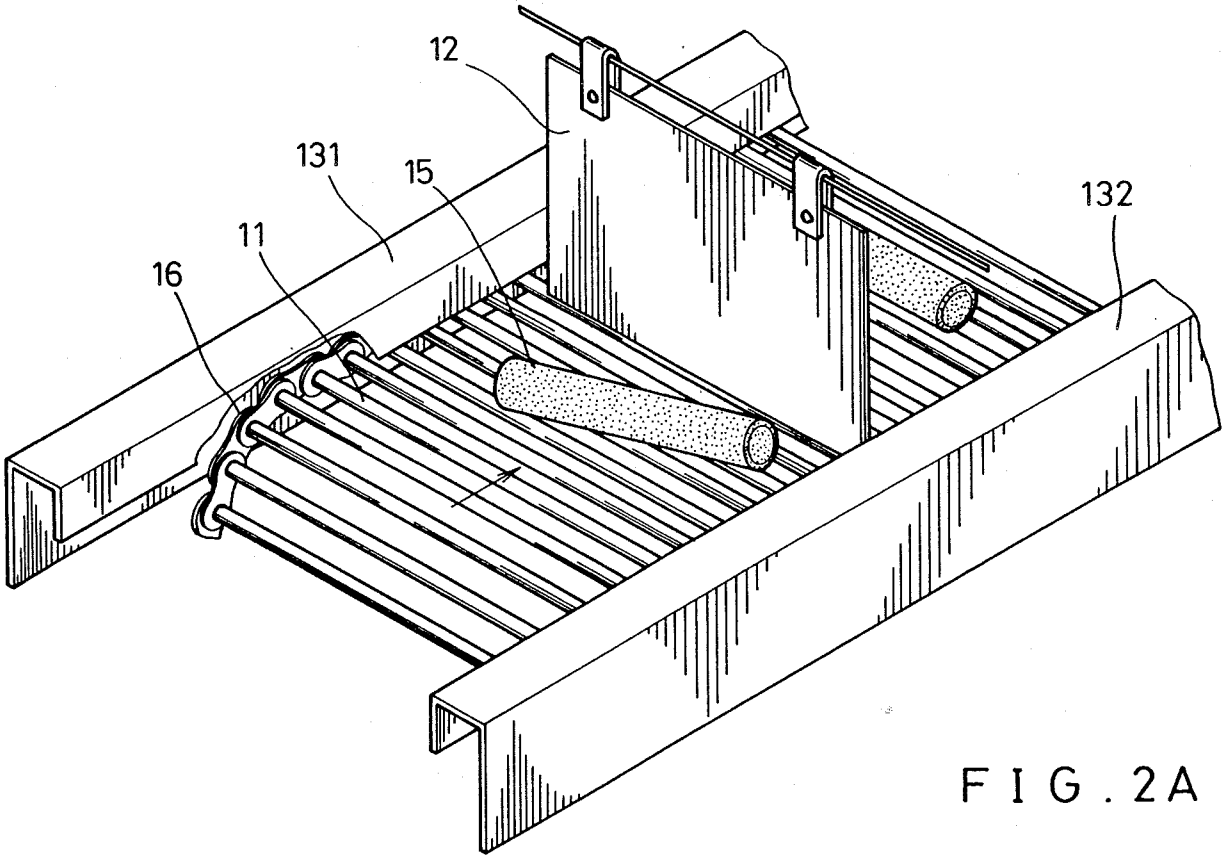
FIG. 2A is a partial perspective view of the apparatus shown in FIG. 1.
Figure 5:
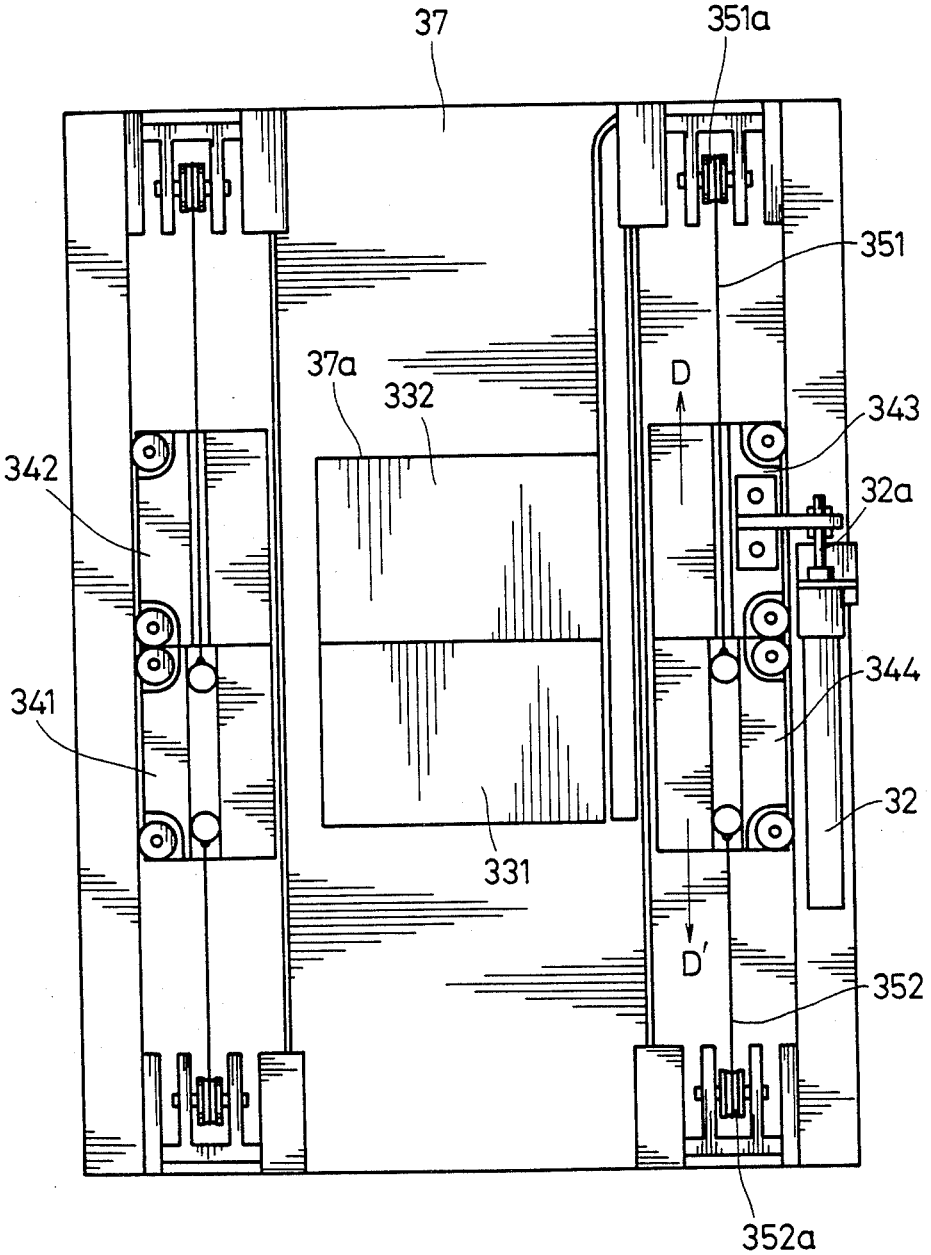
FIG. 5 is an enlaged elevational view showing the stowage mechanism of the automated apparatus for transporting, lining-up and stowing cylindrical fragile bodies according to this invention.

As shown in FIG. 1, the stowage mechanism 3 comprises a receiving plate 37; two air cylinders 31 (see FIG. 3) and 32 (see FIG. 5); and one pair of entry veils 331, 332 slidably mounted beneath the receiving plate 37. The receiving plate 37 together with two entry veils 331, 332 can be pushed upward by the air cylinder 31 to rotate around the pivotal axis 36 and reach an inclined plane flush with the storage chute 21 of the push mechanism 2. Furthermore, a rectangular opening **37*a* is provided in the central portion of the receiving plate 37, and the entry veils 331, 332 are mounted beneath the opening 37*a* to receive the fragile bodies 15, 15, . . . coming from the transportation mechanism 1 when two entry veils 331, 332 are butting together. As shown in FIGS. 5 and 6, two sliders 343, 344 are connected by two cables 351, 352 passing, respectively, around the rollers 351*a*, 352*a*. By this arrangement, when one of the two sliders 343, 344 is driven to move in the direction D or D′, the other one will be conducted to move in the opposite direction D′ or D. As shown in FIG. 5, the end portion of the rod 32A of the air cylinder 32 is connected to the slider 343 so that the rod 32*a* of the air cylinder 32 can drive the slider 343 mounted on the entry veil 332 to move in the direction of the arrow "D" shown in FIG. 5, and at the same time drive, by way of the cables 351 and 352, the slider 342 mounted on the entry veil 331 to move in the direction of the arrow "D'" shown in FIG. 6. By this arrangement, two entry veils 331, 332** can be driven to move apart from or toward each other.

Figure 4:
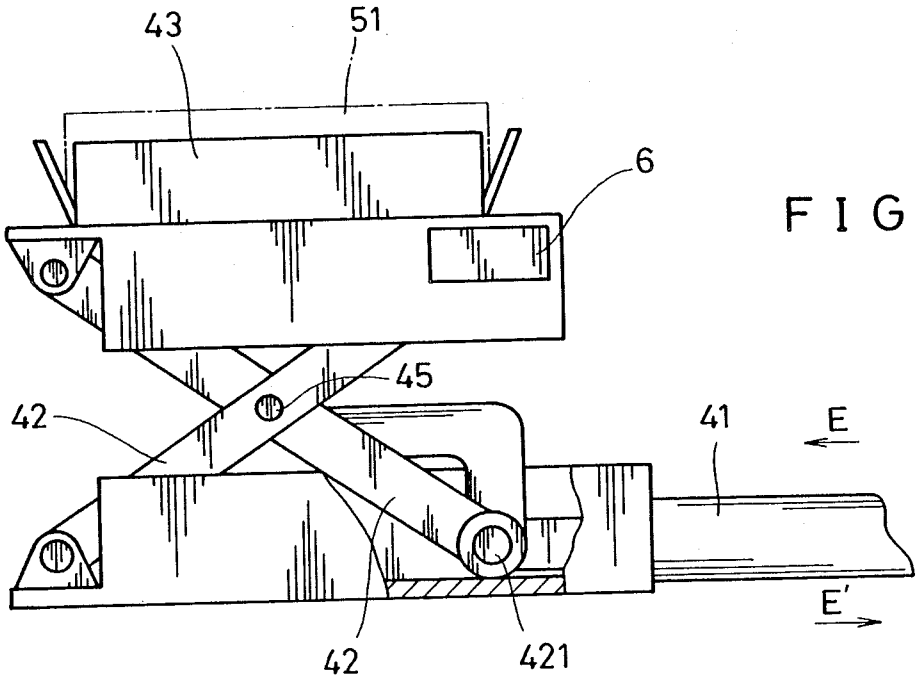
FIG. 4 is a partial elevational side view of the elevation-position mechanism of the automated apparatus for transporting, lining-up and stowing cylindrical fragile bodies according to this invention.

As shown in FIG. 4, the elevation-position mechanism 4 comprises one pair of links 42, 42 being pivoted together at the middle portion thereof; an air cylinder 41; and a bucket 43 mounted on the upper end portions of the links 42, 42. The two links 42, 42 are pivoted at the pivot 45, and the end portion of the piston rod of the air cylinder 41 is pivotally engaged with the lower portion 421 of one link 42 (as shown in FIG. 4). By this construction, the bucket 43 will be driven to move upward when the joint 44 is driven to move in the direction of the arrow "E" shown in FIG. 4, and vice versa. By this arrangement, the bucket 43 can be pushed to approach the entry veils 331, 332.

As shown in FIG. 1, the receptacle supply mechanism 5 comprises a chain 521; a motor 53; a photoelectric sensor 54; and a plurality of push blocks 522, 522, . . . secured on the chain 521, spaced apart at a predetermined distance with one another. The chain 521 together with the blocks 522, 522 is driven by the motor 53 to move in the direction of the arrow "F", and receptacles 51, 51, . . . located between each pair of blocks 522, 522, . . . will be pushed by the blocks 522, 522, . . . toward the elevation-position mechanism 4. When one of the receptacles 51, 51, . . . is pushed to reach the position above the elevation-position mechanism 4, the photoelectric sensor 54 mounted thereon will be activated to stop the rotation of the motor 53 in order to identify the position of the receptacle 51. At this point, the receptacle 51 can be pushed upward by the bucket 43 to approach the entry veils 331, 332.

As shown in FIG. 4, the vibration mechanism 6 is mounted on the exterior of the bucket 43, and vibrates at a predetermined frequency at the instant of receiving signal from the microprocessor (not shown).

The following is the description of the operation of the automated apparatus for transporting, lining-up and stowing cylindrical fragile bodies according to this invention.

Before describing the operation, it should be noted that all the processes described below are controlled by a microprocessor (not shown).

As shown in FIGS. 1 and 2, the cylindrical fragile bodies 15, 15, . . . are supplied onto the tubes 11, 11, . . . from a supply source (not shown). Each of the fragile bodies 15, 15, . . . will be interposed between two tubes 11, 11, . . . , and the upper guide plate 12 will align them in a juxtaposed manner, when the chains 16, 16 are driven to move in the direction of arrow B. Both ends of each fragile body will be lined up by the side guide plates 131, 132, when the chains 16, 16 are driven to pass therebetween. After passing through the side guide plates 131, 132, the fragile bodies 15, 15, . . . will slide down through the passage formed within the chute 21 and be impeded by the bottom ridge 211 to align on the chute 21 in a juxtaposed manner. When the row of fragile bodies 15, 15, . . . aligned on the chute 21, reaches the photoelectric sensor 242, the air cylinder 22 is activated to drive the slide plate 23 to move in the direction of the arrow "C" across the lower portion of the chute 21 to push the fragile bodies 15, 15, . . . aligned in front of the slide plate 23, into the rectangular opening **37*a*, that is the entry veils 331, 332, of the receiving plate 37 of the stowage mechanism 3. It should be noted that the rotation of the motor 14 will pause when the row of fragile bodies 15, 15, . . . reaches the photoelectric sensor 241 after passing through the photoelectric sensor 242. At the same time, the operation of the transportation mechanism 1 will be stopped to avoid any overflow of fragile bodies 15, 15, . . . Before the air cylinder 22 is reactivated again, the receiving plate 37 together with two entry veils 331, 332 will be pushed upward by the air cylinder 31 to rotate around the pivotal axis 36 and reach an inclined plane flush with the storage chute 21 of the push mechanism 2. The fragile bodies 15, 15, . . . will be supported by the two entry veils 331, 332 when the two entry veils 331, 332 are butting together. After receiving the fragile bodies 15, 15, . . . from the push mechanism 2, the receiving plate 37 together with two entry veils 331, 332 will be pulled downward by the air cylinder 31 to rotate around the pivotal axis 36 to return to its original horizontal attitude. After this, one of the receptacles 51, 51, . . . is pushed to reach the position above the elevation-position mechanism 4, and the photoelectric sensor 54 mounted thereon will be actuated to stop the rotation of the motor 53 to locate the receptacle 51, then, the receptacle 51 will be pushed upward by the bucket 43 to approach the entry veils 331, 332. Then, the rod 32*a* of the air cylinder 32 drives the slider 343 mounted on the entry veil 332 to move in the direction of the arrow "D", and, at the same time, drives, by way of the cables 351 and 352, the slider 342 mounted on the entry veil 331 to move in the direction of the arrow "D'", so that the two entry veils 331, 332 will be driven to move apart from each other. Subsequently, the fragile bodies supported thereon drop into the receptacle 51 which is pushed near the two entry veils 331, 332. If the fragile bodies 15, 15, . . . are to be arranged in multilayers within the receptacles 51, the reciprocating rotations of the receiving plate 37 and the opposite motions of the two entry veils will be repeated until the receptacle 51 is filled up. After the receptacle 51 is filled up, the vibration mechanism 6 is actuated to vibrate so as to make the fragile bodies filled within the receptacle become more compact. Finally, the bucket 43 together with the receptacle 51 is driven to move downward, and the receptacle 51 is transported away from the elevation-position mechanism 4 by the receptacle supply mechanism 5**.

As described above, the apparatus according to this invention can automatically transport, line up and stow cylindrical fragile bodies such as egg rolls, to achieve efficiency and sanitation.

Furthermore, the apparatus according to this invention would drive the receptacle to approach the entry veils to avoid breakage of the fragile bodies during stowing.

In addition, the vibration mechanism makes the fragile bodies arranged within receptacles in a compact manner.

Although the invention has been described in its preferred form with a certain degree of particularity, it is to be understood that the present disclosure of the preferred form has been somewhat changed, whereas the details of construction and the combination and arrangement of parts may be referred to without departing from the spirit and the scope of the invention as hereinafter claimed.

What is claimed is:

1. An automated apparatus for transportating, lining-up and stowing cylindrical fragile bodies comprising: a first receiving means for receiving a supply of cylindrical fragile bodies, means for supplying receptacles;

means for transporting cylindrical fragile bodies coming from said first receiving means;

means for accommodating cylindrical fragile bodies coming from said transporting means temporarily, and pushing them out in lots and in a predetermined sequence;

second receiving means for receiving cylindrical fragile bodies pushed out from said accommodating means and stowing them into receptacles coming from said supplying means;

means for elevating the receptacles coming from said supplying means and holding them temporarily near said second receiving means; and means for controlling all the processes of the automated apparatus for transporting, lining-up and stowing cylindrical fragile bodies, said controlling means being coupled to said transporting, accommodating, receiving and elevating means.

2. An automated apparatus as claimed in claim 1, further comprising means for vibrating said elevating means.

3. An apparatus as claimed in claim 2, wherein said transporting means comprises:

one pair of parallel endless chains;

a plurality of cylindrical tubes for supporting cylindrical fragile bodies therebetween, which tubes are juxtaposed with each other between said pair of chains and perpendicular to said pair of chains, a first motor for driving said pair of chains to move in their longitudinal direction;

an upper guide plate spaced apart from said tubes at a predetermined distance so as to allow cylindrical fragile bodies passing under said upper guid plate one at a time; and one pair of side guide plates disposed oppositely along two longitudinal sides of said pair of chains to line-up both ends of each fragile body when said pair of chains are driven to move continuously.

4. An automated apparatus as claimed in claim 3, wherein said accommodating means comprises:

an inclined storage chute for receiving cylindrical fragile bodies coming from said transporting means temporarily;

a first air cylinder; and a slide plate driven by said first air cylinder for pushing the cylindrical fragile bodies received within said storage chute out from said storage in lots and in a predetermined sequence.

5. An automated apparatus as claimed in claim 4, further comprising:

a first photoelectric sensor mounted on said storage chute for detecting the timing of actuation of said first air cylinder; and a second photoelectric sensor mounted on said storage chute for detecting the timing of pause or actuation of said first motor.

6. An automated apparatus as claimed in claim 4, wherein the angle between said inclined storage chute and horizontal plane is about 17 degrees.

7. An automated apparatus as claimed in claim 4, wherein said second receiving means comprises:

a receiving plate for receiving cylindrical fragile bodies coming from said accommodating means, having a rectangular opening formed in the central portion thereof, which receiving plate is pivotally mounted on said storage chute so as to be rotated between a horizontal plane and an inclined plane flush with said storage chute;

a second air cylinder for driving said receiving plate to facilitate said rotation;

one pair of entry veils slidably mounted beneath said receiving plate, and being rotated together with said receiving plate; and means for driving said pair of entry veils to slide oppositely with each other.

8. An automated apparatus as claimed in claim 7, wherein said supplying means comprises:

an endless chain;

a plurality of blocks integrally mounted on said endless chain at predetermined spaces for accommodating receptacles; and a second motor for driving said endless chain to move in its longitudinal direction.

9. An automated apparatus as claimed in claim 8, wherein said elevating means comprises:

one pair of links having an upper end and a lower end, respectively, which pair of links are pivotally joined at their middle portions;

a third air cylinder for driving said pair of links to rotate pivotally with each other; and a bucket mounted on the upper ends of said links for being driven to approach or move away from said pair of veils when said pair of links are driven to rotate pivotally with each other.

10. An automated apparatus as claimed in claim 9, wherein said vibrating means is fixedly secured on said bucket of said elevating means.

* * * * *